United States Patent [19]

Roederer

[11] Patent Number: 4,804,965

[45] Date of Patent: Feb. 14, 1989

[54] FLAT WIDE-BAND ANTENNA

[75] Inventor: Antoine G. Roederer, Paris, France

[73] Assignee: Agence Spatiale Europeenne, Paris, France

[21] Appl. No.: 880,795

[22] Filed: Jul. 1, 1986

[30] Foreign Application Priority Data

Jul. 9, 1985 [FR] France ..... 85 10463

[51] Int. Cl.[4] ..... H01Q 1/38; H01Q 7/00

[52] U.S. Cl. ..... 343/700 MS; 343/742; 343/866

[58] Field of Search ..... 343/700 MS, 723, 726, 343/733, 741, 742, 743, 756, 797, 866, 867, 908, 909

[56] References Cited

U.S. PATENT DOCUMENTS

| | | | |
|---|---|---|---|
| 2,537,191 | 1/1951 | Moore | 343/742 |
| 2,551,664 | 5/1951 | Galper | 343/908 |
| 3,530,486 | 9/1970 | Strider | 343/908 |
| 3,534,372 | 10/1970 | Scheuerecker et al. | 343/742 |
| 3,689,929 | 9/1972 | Moody | 343/818 |
| 3,716,861 | 2/1973 | Root | 343/741 |
| 4,012,742 | 3/1977 | Dempsey | 343/742 |

FOREIGN PATENT DOCUMENTS

| | | | |
|---|---|---|---|
| 0474438 | 4/1929 | Fed. Rep. of Germany | 343/867 |
| 0325319 | 6/1970 | Sweden | 343/797 |

*Primary Examiner*—William L. Sikes
*Assistant Examiner*—Doris J. Johnson
*Attorney, Agent, or Firm*—Kenyon & Kenyon

[57] ABSTRACT

An antenna for receiving or transmitting electromagnetic waves with circular polarization or, in certain configurations, linear polarization. The antenna element is low-cost, wide-band and medium-gain broadside antenna element which may be used alone or in arrays. One embodiment disclosed comprises a wire or microstrip conductor outlining a cruciform shaped loop parallel to a conductive plane from which it is separated by a dielectric layer. The lengths and widths of the branches of the cruciform loop are chosen to be λg/2 and λg/N respectively, where λg is the guide wavelength of the radiative transmission line formed by the conductor and plane. The antenna element is applicable to mobile earth-bound terminals for selective communications, for example.

20 Claims, 4 Drawing Sheets

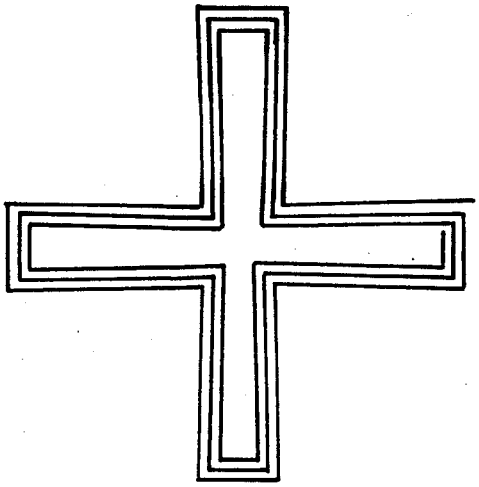
FIG.5a
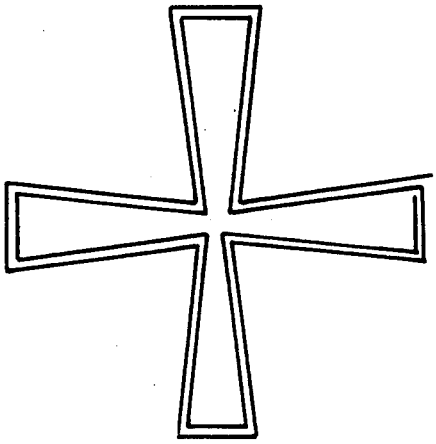
FIG.5b
FIG.5c
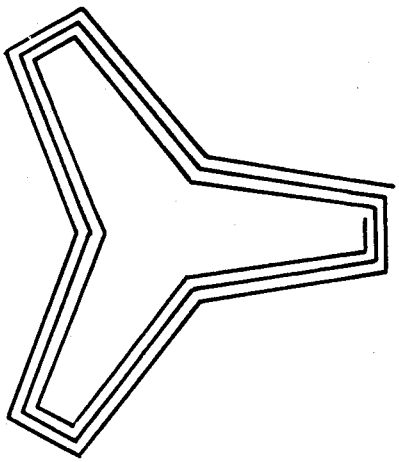
FIG.5d
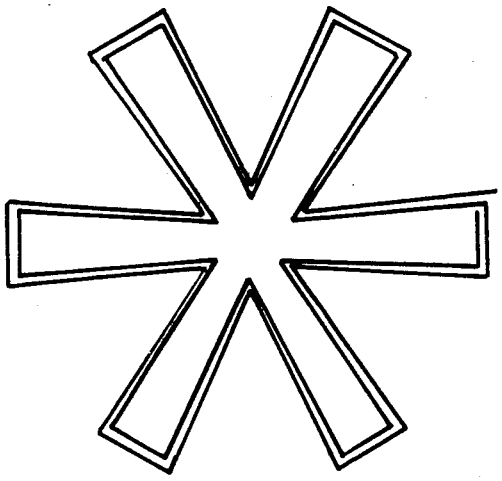

FIG. 8
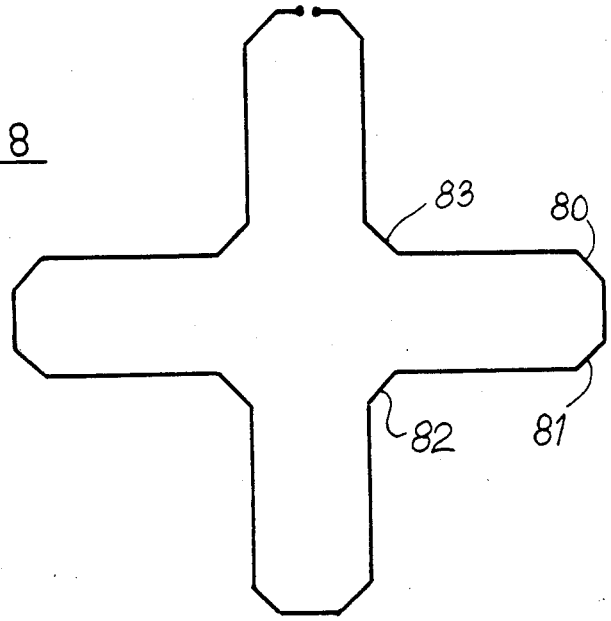
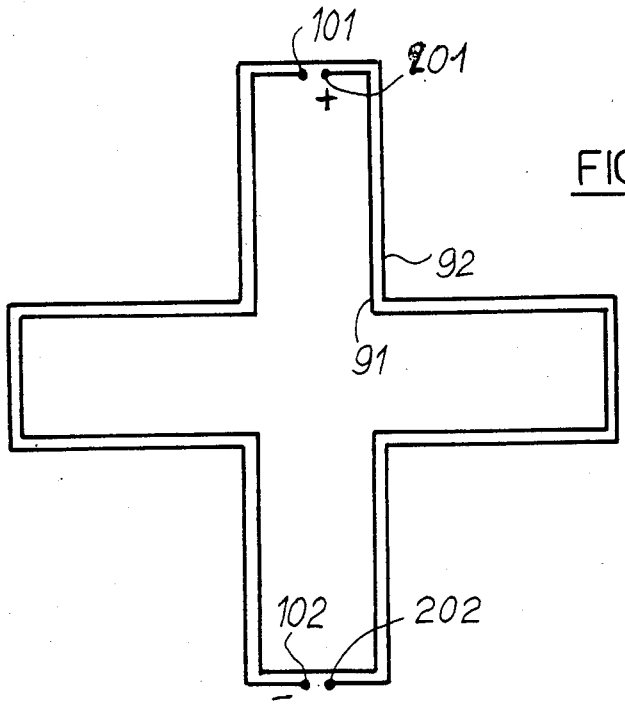
FIG. 9

FLAT WIDE-BAND ANTENNA

BACKGROUND OF THE INVENTION

This invention relates to an antenna for receiving or transmitting electromagnetic waves with circular polarisation or, in certain configurations with linear polarization.

Structurally, the antenna is flat and is suitable for manufacture using printed circuit techniques, so that the antenna may be inexpensive and of low weight.

The antenna of the invention may be designed to have a wide frequency pass band compared to other printed circuit type antennas and a medium gain.

The invention also relates to various preferred applications of the antenna, as a function of the configuration produced.

The invention may advantageously be applied to mass-production equipment of mobile earthbound terminals or television receivers for satellite communications.

The invention also relates to an advantageous method of producing such an antenna.

DESCRIPTION OF THE PRIOR ART

Two flat antennas which are described in the prior art are a "rampart" antenna, which is shown in FIG. 1 of the accompanying drawings, and a "chain" antenna.

An article by NISHIMURA Sadahiko entitled "cranktype circularly polarized microstrip line antenna" appeared in the 1983 International Symposium Digest ANTENNAS AND PROPAGATION, HOUSTON 23 á 26 Mai 1983 at pages 162 to 165 and an article by J. R. James entitled "Some recent developments in micro-strip antenna design" appeared in the IEEE TRAN SACTIONS ON ANTENNAS AND PROPAGATION of January 1981 at pages 124 to 127. These articles disclose a "rampart" antenna comprising a straight line of cranks connected in series with each other. The cranks have a height of $\lambda g/2$, a width of $\lambda g/4$ and are connected to the next one by linear elements whose length is 3 $\lambda g/4$. The line of cranks is disposed in a single plane which is mounted parallel to and above a conductive plate. $\lambda g$ corresponds to the guided wave-length for the waves propagated between the wire of microstrip conductor forming the line of cranks and the conductive plate.

A preferred method of producing this known antenna consists of etching with acid one face of a double-sided printed circuit board so as to leave apparent the line of cranks, the other face serving as the conductive plate associated with the line of cranks to form the waveguide.

The disposition and length of each of the cranks enables a circularly polarized electric field to be generated when the line is energized by current of a suitable frequency. However, this type of antenna presents at least two disadvantages:

- the efficiency of the antenna is low since in each 3 g/4 link segment, the current, flowing is equal and opposite to that flowing at the other end so that the radiation from the two ends cancel each other out. The link segments are therefore ineffective as far as radiation is concerned;
- because of the relatively extended linear configuration of the rampart antenna, which has been made in a configuration where each line comprises 16 aligned cranks, the radiation pattern is very elliptical, which limits the sweep field of an array of rampart antennas and causes parasitic array lobes to appear adjacent to the radiation axis.

The "chain" antenna is described in an article by J. HENRIKSON entitled "A circularly polarized travelling wave chain antenna" published in THE PROCEEDINGS OF THE 9th EUROPEAN MICROWAVE CONFERENCE BRIGHTON, 17 a 20 September 1979 page 174 á 178.

In fact, it appears that the chain antenna presents the same disadvantages referred to above with respect to the rampart antenna.

Another known method of making a flat antenna comprises using sub-arrays of ordinary elements (crossed dipoles, spirals, microstrip elements) energized by a splitter. One known configuration of the kind disclosed in the J. R. James article referred to above is shown in FIG. 2 of the accompanying drawings, and comprises a circularly polarized sub-array comprising four square flat elements placed on a common substrate. This type of sub-array is complex and expensive and its pass-band is very narrow. Moreover, the feeding circuit used is the source of major losses, to the extent that it is usually disposed behind the ground plane and not printed on the same plane as the antenna elements so as not to perturb the radiation.

OBJECTS OF THE PRESENT INVENTION

An object of the present invention is to avoid some or all of the disadvantages of the prior art referred to above.

Another object of the invention is to provide a flat antenna of wide frequency pass-band and medium gain. More specific objects are to enable main operation in a circularly polarized mode and to offer a reduced manufacturing cost. The object of obtaining medium gain is explained by the usefulness of limiting the number of feed points for the antennas and hence the complexity as well as the losses likely to appear in arrays of the antenna elements.

Yet another object of the invention is to provide an antenna of this kind which can radiate in a solid angle defined by a cone of at least 10° half-angle.

A complementary object of the invention is to provide an antenna of this kind which can be printed and, more particularly, produced by means of printed circuit technology.

Yet another object of the invention is to provide independent antenna elements which may be used in isolation or in arrays.

Still another important object of the invention is to provide a flat antenna which, according to its energization mode, is capable of transmitting or receiving either circularly polarized radiation or linearly polarized radiation, with the supplementary feature in each case of being able to operate selectively with one given circular or linear polarization and alternatively with the opposite circular polarization or orthogonal linear polarization respectively.

DESCRIPTION OF THE INVENTION

The present invention provides an antenna element comprising a conductive plate, and at least one elongate conductive member presenting first and second ends disposed adjacent each other, said elongate member being juxtaposed with said plate with a dielectric layer therebetween, whereby to form a radiative transmission line, and said elongate member forming a loop between said ends, said loop outlining a shape comprising N branches extending outwardly from a common centre, N being a number at least as great as three, each branch comprising first and second lateral elements extending outwards from said centre and an end element remote from said centre connecting said lateral elements, the lengths of said end elements being substantially equal to $\lambda g/2$ and the lengths of said lateral elements being substantially equal to $\lambda g/N$, where $\lambda g$ is the guided wave-length in said transmission line.

It is to be noted that any odd multiple of $\lambda g/2$ and $\lambda g/N$ is suitable for the length of the end elements and lateral elements of the antenna, respectively.

The expression radiative transmission refers to a transmission line which radiates if energized; it will equally pick up radiation in the case of a receiving antenna.

In a preferred embodiment, said conductive plate extends in a first plane and said elongate member extends in said loop in a second plane parallel to said first plane.

In a particular embodiment, said loop passes at least twice round said shape, with successive turns being in the same plane and disposed one within the other with a small interval therebetween.

In another embodiment, said loop passes at least twice round said shape, with successive turns being superimposed one on the other perpendicularly to said plane.

The invention also includes antenna apparatus including an array of a plurality of said antenna elements with a common conductive plate and coupling means coupling the elongate members.

The invention also includes a method of making the antenna element.

DESCRIPTION OF THE DRAWINGS

Other features and advantages of the invention will appear from the following description of some preferred embodiments thereof, given by way of example, with reference to the accompanying drawings, in which:

FIGS. 5*a* to 5*d* are diagrammatic plan views of antenna elements in accordance with other advantageous embodiments of the invention, obtained by varying the number of branches of the array and the number of loops of the conductor;

FIG. 8 is a diagrammatic plan view of an antenna element in the shape of a cruciform with angled corners; and FIG. 9 is a diagrammatic plan view of an antenna element in accordance with yet another embodiment of the invention comprising two independent superposed loops of cruciform shape.

DESCRIPTION OF THE EMBODIMENTS OF THE INVENTION

Figure 1:
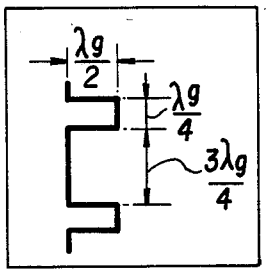
FIG. 1 PRIOR ART
FIG. 1 is a plan view of a rampart antenna according to a prior art design.
Figure 2:
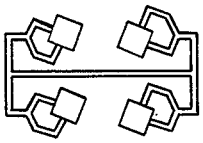
FIG. 2 PRIOR ART
FIG. 2 is a diagrammatic plan view of a sub-array in a prior art antenna comprising four square patches connected together.
Figure 3:
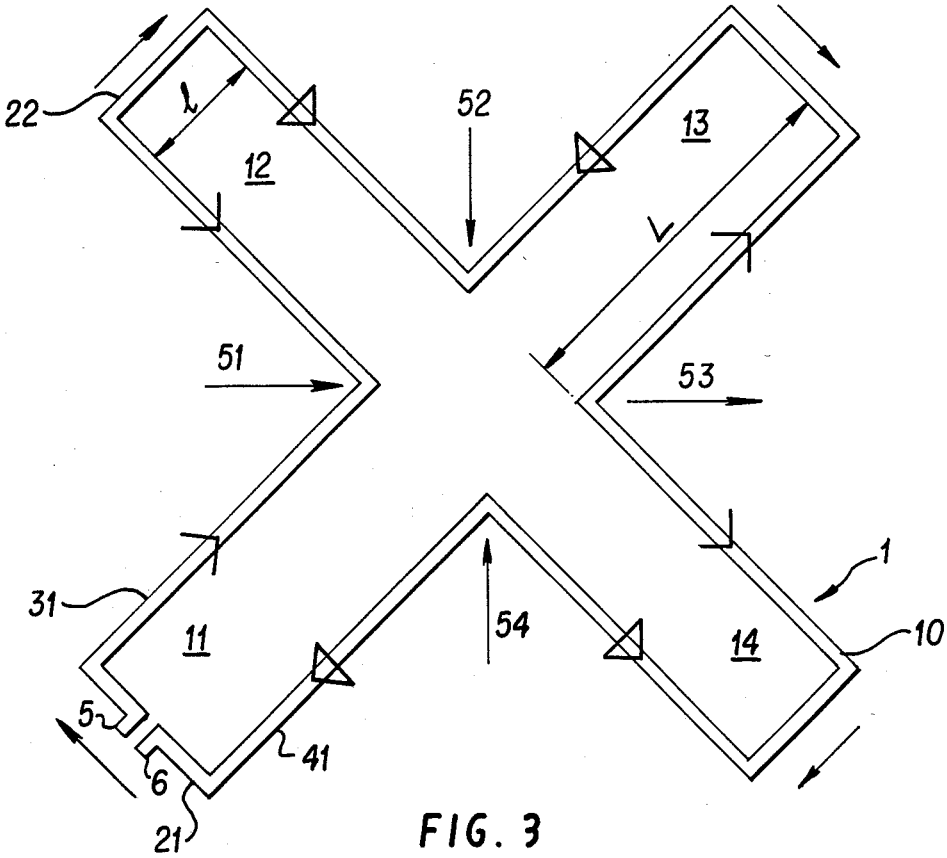
FIG. 3 is a diagrammatic plan view of an antenna element in accordance with a first embodiment of the invention, with arrows indicating the phase conditions of the travelling wave propagated therein at a given instant.
Figure 4:
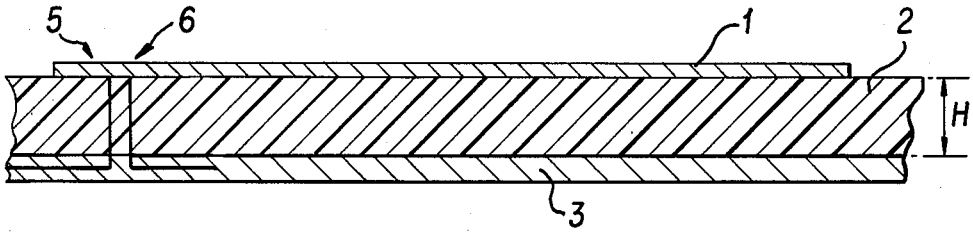
FIG. 4 is a sectional side-view of the antenna element of FIG. 3.

As shown in FIGS. 3 and 4, a simple method of making an antenna in accordance with the present invention comprises mounting. a wire or micro-strip conductor in a branching loop, as seen in plan view in FIG. 3, at one face of a dielectric support 2 parallel with a conductive plane 3 disposed at the other face of the dielectric layer.

It will be appreciated that the dielectric layer may simply be air.

In another method, the cruciform loop 1 is produced by photographic printing or etching or another suitable technique on a thin dielectric skin applied to a flat honeycomb or foam insulator structure, itself applied to a conductive plate.

Yet another method comprises taking a triple sandwich board comprising a central dielectric layer and two outer conductive layers of copper or other suitable metal, one of the plates being etched, by acid for example, to define one or more loops of the desired branching shape.

The connection to the antenna element may be obtained by lines comprising cylindrical or rectangular coaxial cables, the antenna loop being connected to an extension of the central conductor of the cable.

As shown in FIG. 3, the branching loop 1 comprises a single wire or micro-strip conductor 10 extending around the outline of a cross with four branches 11, 12, 13 and 14. The loop forms the shape of an empty cross of which only the peripheral edge is conductive over a narrow width, the width of the wire or micro-strip.

The conductive loop is interrupted for a short distance in the end portion 21 of one of the branches 11 of the cross at the ends 5 and 6 of the conductor.

In the embodiment shown in FIG. 3, which is only one possible configuration for the antenna element, the wire or printed strip conductor 10 follows an almost closed cruciform outline and forms a travelling wave transmission line with the conductive plane 3 from which it is separated by the dielectric layer 2.

The characteristic dimensions of the antenna element are the sizes of the branches 11, 12, 13 and 14 of the cruciform loop, and the depth of the dielectric layer separating the cruciform loop 1 from the conductive plane 3.

In an advantageous embodiment, the conductor 10 follows the outline of a regular cross, each of whose branches comprises two lateral segments, which may be parallel or non-parallel, and an end segment. The length L of each of the lateral segments is preferably equal to half the guided wave-length in the transmission line of the radiation to be transmitted or received ($L=\lambda g/2$). The length of the end segment of each branch is preferably equal to this wave-length divided by N, where N is the number of branches in the branching loop formed by the conductor 10. In the cruciform example shown in FIG. 3, there are four branches, and the end segments of the branches 11, 12, 13 and 14 each have a length L equal to one quarter of the wavelength.

The depth H separating the cruciform loop 1 from the conductive plane 3 is chosen so that the travelling wave line defined by the loop 1 and cooperating plane 3 radiates part of the travelling power. More precisely, the depth H is calculated so that when an alternating potential difference is applied between one end 5 of the branching loop 1 and the conductive plane 3, the attenuation of the wave propagated along the line is sufficient for the power arriving at the other end 6 of the line is negligeable, for example being less than 5% of the power at the input end 5. In this way, the efficiency of the antenna element is optimized to the extent that the power is substantially all dissipated in radiation.

When the dielectric layer 2 is air, the depth H is preferably between 1/10 and 1/5 times the transmitted or received wavelength.

If the loop is energized in the mode described above, by applying an alternating potential difference to one end 5 only of the cruciform loop 1 and the conductive plane 3, a particular current distribution along the line is obtained.

Thus, this energization mode produces a travelling wave of wave-length $\lambda g$ which is propagated along the transmission line. The currents flowing at a given instant in each of the segments of the loop produce electromagnetic fields which cooperate with each other. At the point in time illustrated in FIG. 3, the lateral segment 31 of the branch 11 of the cruciform loop 1 is, for example, at phase 0° or 180° (open arrow). The lateral segment 41 of the same branch 11 is simultaneously at phase 90° or 270° respectively (closed arrow) and the end segment 21 is at phase 225° or 45° respectively (semiclosed arrow). The semi-closed arrow also represents the phases 315° or 135° respectively in the end segment 22 of the branch 12 of the cruciform loop, for example.

The phase distribution of the travelling wave can be obtained readily by representing along the line the sinusoid representing the current therein at a given moment.

It will then be appreciated that, for the configuration of FIG. 3, resultant electro-magnetic fields appear due to the cooperation of the joined lateral segments of each adjacent pair of branches (11, 12; 12, 13; 13, 14; 14, 11). The electric fields thus created have components represented by arrows 51, 52, 53 and 54. It is clear that these components are the components that the electric field adopts at a particular moment in the periodic cycle of the propagation of the wave along the line. In fact, since the antenna forms a radiating travelling wave transmission line, the electric field, which gives the polarization, rotates in the plane of the branching loop.

It will be appreciated that when an antenna in accordance with this embodiment of the invention is energized by one end 5 only, it radiates in a circularly polarized mode. It will be noted that, if the branching loop is energized by its other end 6 instead, the circular polarization of the radiation is the opposite of the radiation when it is energized by the end 5.

Moreover, the mechanism obtained of radiation by travelling wave has a wide band-width.

If both ends 5 and 6 of the branching loop 1 are energized simultaneously, either in phase or with phase opposition, the radiation obtained is polarized linearly.

In fact, unlike a rampart antenna, in this case there is no partial cancellation of the radiation by opposed currents and the radiation pattern is symmetrical about the normal to the antenna. According to the energization phase of the two ends 5 and 6, either a given linear polarization, or the orthogonal linear polarization is obtained. The usage of this type of antenna is accordingly very flexible.

In the case of use in circular polarization, the end of the branching loop opposite to the energized end may be terminated by a suitable load where 5% to 10% of the input power may be dissipated. In different cases, it is also possible to leave this end open-circuit or to short-circuit it.

FIGS. 5*a*, 5*b*, 5*c* and 5*d* illustrate other embodiments of the branching loop of an antenna element in accordance with the invention.

FIG. 5*a* shows an element of cross shape with four branches and a triple loop.

FIG. 5*b* shows a cruciform element with four branches and a double loop in the shape of a Maltese cross.

FIG. 5*c* shows an element with three branches and a triple loop, the inner end of each branch being wider spaced than the outer end, which is the contrary of the Maltese cross shape of FIG. 5*b*.

FIG. 5*d* shows an element with six branches and a double loop.

It is clear that, provided the principle of sizing the branches is respected, with the length of the lateral elements substantially equal to $\lambda g/2$ and the length of the end elements substantially equal to $\lambda g/N$, N being the number of branches, with an angular separation of $2\pi/N$ between each branch, any suitable value of N may be chosen.

The element may also be a branching loop such as shown in FIG. 8, in which the corners 80, 81, 82 and 83 of the branches are angled as shown, or rounded.

Figure 6:
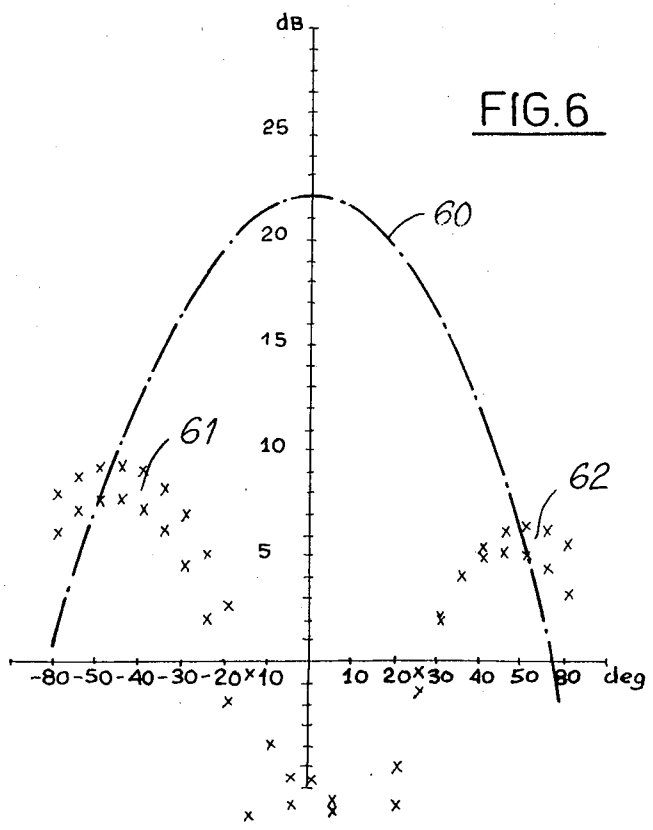
FIG. 6 is a diagram representing the calculated radiation field corresponding to the antenna element of FIG. 5*d;*

The radiation pattern of an antenna element with six branches and a double loop is shown in FIG. 6. It will be seen that it comprises essentially a main lobe 60 which is symmetrical about the normal to the antenna plane passing through its centre, and two side lobes which are much smaller and are centred substantially at an angle of about 45° to 50° relative to the normal.

Figure 7:
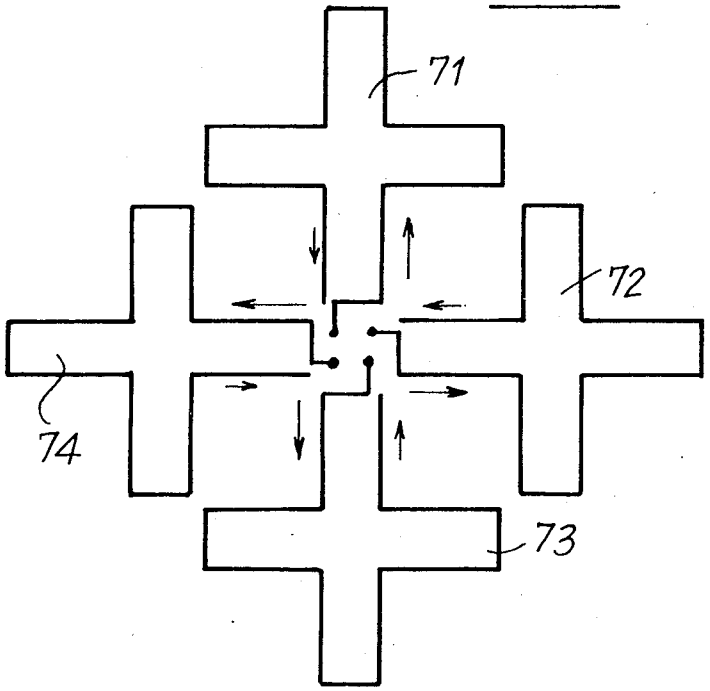
FIG. 7 is a diagrammatic plan view of a group of cruciform antenna elements in accordance with an embodiment of the invention and forming array or sub-array.

The antenna elements in accordance with the invention may be grouped in a subarray or an array as shown in FIG. 7. In the sub-array shown, four cruciform antenna elements 71, 72, 73 and 74 are disposed so that their respective energizing ends are grouped at the centre of the sub-array. This especially enables perturbations which would be introduced into the radiation to be limited.

Preferably, the antenna elements 71, 72, 73 and 74 are energized by means of a power splitter, advantageously mounted at the rear of the conductive plane, the energization point of each element being chosen symmetrically relative to the centre of the sub-array. The fields radiated by each element of the sub-array are therefore also symmetrical with respect to the centre.

Such a sub-array may of course be used either along or in cooperation with other sub-arrays. There is no limitation to the number of sub-arrays in the array. The antenna elements in each sub-array or array may be formed with any suitable number of branches, number of loops and shape.

FIG. 9 shows an antenna element in accordance with yet another embodiment of the invention including a plurality of independent conductors forming the same shape of branching loops. In the example illustrated, two wire or micro-strip conductors 91 and 92 form two continuous, almost closed, flat cruciform loops placed in the same plane parallel to a conductive plate (not shown), the first loop following externally with a small gap the same cruciform outline as the second loop, so that the inner loop 91 is inscribed exactly within the outer loop 92. The ends 101, 201 of the conductor 91 and the ends 102, 202 of the conductor 92 are disposed symmetrically opposite each other. The energization is effected so that the currents flowing in adjacent portions of the two loops are parallel and flowing instantaneously in the same direction.

The antenna elements and arrays of different embodiments of the invention are described above by way of illustration and without the list being exhaustive. Various advantageous application of the antennas are described below.

The antennas described above are particularly suitable for use in mobile terminals, such as cars, trucks and ships, for satellite communication links. They are also suitable for receiving signals from television broadcasting or distribution satellites. These antennas can also be used in satellites designed for communication with earth-based mobile terminals, either as a direct radiation antenna or as a source antenna of a reflector system.

The antenna may also be used for radiofrequency angualr trashing operations, when it is made in the form of an array of four cruciform loops or a multiple of four cruciform loops, the loops being energized to form one "sum" channel and two "difference" channels. As an illustration of this, the tracking could be performed with the arrangement shown in FIG. 7, in which the sum pattern would be obtained by feeding elements 71, 72, 73, and 74 with equal amplitudes and phases respectively at 0°, 90°, 180°, 270°, one difference pattern using instead phases 0°, 90°, 0°, 90°, and the other difference pattern using phases 0°, 270°, 0°, 270°. The feeding arrangement to create these three laws can be realized using 3 dB power dividers as is classically done in "monopulse" systems. A model of antenna with a uniform loop shape with eight branches has been produced and subjected to tests. The impedance of the antenna was designed for operation at 3GHz. It was found that the power remaining at the non-energized end of the loop, whose length was nine wave-lengths, was 10.3 dB less than the input power. The radiation of this type of antenna is therefore quite remarkable.

I claim:

1. An antenna element comprising a conductive plate, and at least one elongate conductive member presenting first and second ends disposed adjacent each other, said elongate member being juxtaposed with said plate with a dielectric layer therebetween, a generator/receiver being connected at a first end thereof to the antenna at said conductive plate and at a second end to one of said first and second ends to form a radiating line asymmetrically fed, and said elongated member forming a loop between said ends, said loop outlining a shape comprising N branches extending outwardly from a common center, N being a number at least as great as three, each branch comprising a first and second lateral element extending outwards from said center and an end element remote from said center connecting said lateral elements, the lengths of said end elements being substantially equal to $\lambda g/N$ and the lengths of said lateral elements being substantially equal to $\lambda g/2$, where $\lambda g$ is the guided wave-length in said radiating line.

2. an antenna element as claimed in claim 1, wherein said conductive plate extends in a first plane and said elongate member extends in said loop in a second plane parallel to said first plane.

3. An antenna element as claimed in claim 2, wherein said loop passes at least twice round said shape, with successive turns being in the same plane and disposed one within the other with a small interval therebetween.

4. An antenna element as claimed in claim 2, wherein said loop passes at least twice round said shape, with successive turns being superimposed one on the other with the centers of said loops being therefor aligned on an axis perpendicular to said ground plane.

5. An antenna element as claimed in claim 1, wherein said end segments include a main portion and first and second secondary portions extending at obtuse angles from said main portion, said first and secondary portions connected to respective ones of said lateral segments.

6. An antenna element as claimed in claim 1, wherein said end segments join with said lateral segments in rounded corners.

7. An antenna element as claimed in claim 1 and including a plurality of said elongate conductive members outlining said shape independently, said ends of one elongate gate members being disposed symmetrically relative to said ends of another of said elongate members with respect to said centre, and coupling means for coupling said transmission lines of said elongate members.

8. An antenna element as claimed in claim 7, wherein said coupling means are disposed on the opposite side of said conductive plate from said elongate members.

9. An antenna element as claimed in claim 1, wherein said first and second ends are disposed substantially at the middle of said end element of one of said branches.

10. Antenna apparatus including an antenna element as claimed in claim 1 and feed means coupled only with said first end whereby said antenna element operates in two orthogonal linear polarizations of substantially equal power and phase-shifted by 90° whereby to operate in circular polarization with a propagation direction normal to said conductive plate.

11. Antenna apparatus as claimed in claim 13, wherein said feed means includes switch means for coupling said feed means selectively with said second end instead of said first end, whereby to invert said circular polarization.

12. Antenna apparatus including an antenna element as claimed in claim 1 and feed means coupled with said first and second ends in selected phase relationship whereby said antenna element operates in linear polarization.

13. Antenna apparatus as claimed in claim 15, wherein said feed means includes switch means for inverting said phase relationship, whereby antenna element operates in an orthogonal linear polarization.

14. Antenna apparatus including an antenna element as claimed in claim 10 and coupling means for coupling said loops symmetrically whereby current flows in said loops are in similar directions.

15. Antenna apparatus including a multiple of four antenna elements as claimed in claim 1 with said conductive plates parallel and in the same plane and coupling means for coupling said antenna elements said plane.

16. A method of making an antenna element as claimed in claim 1 comprising producing said elongate member on a skin of dielectric material, applying said skin to a structural dielectric member to which said conductive plate is applied and connecting a coaxial cable conductor to said antenna element.

17. A method of making an antenna element as claimed in claim 1, comprising producing a double-sided printed circuit board with said conductive plate on one side and a conductive layer on an opposite side thereof, and said dielectric layer therebetween, said elongate conductive member being produced by a method including removal of material from said conductive layer and connecting a coaxial cable conductor with said antenna element.

18. Antenna apparatus comprising:

a plurality of antenna elements wherein each antenna element comprises, a conductive plate, and at least one elongate conductive member presenting first and second ends disposed adjacent each other, said elongate member bieng juxtaposed with said plate with a dielectric layer therebetween; a generator/receiver being connected at a first end thereof to the antenna at said conductive plate and at a second end thereof to one of said first and second ends to form a radiating line asymmetrically fed, and said elongate member forming a loop between said ends, said loop outlining a shape comprising N branches extending outwardly from a common center, N being a number at least as great as three, each branch comprising a first and second lateral element extending outwards from said center and an end element remote from said center connecting said lateral elements, the lengths of said end elements being substantially equal to $\lambda g/N$ and the lengths of said lateral elements being substantially equal to $\lambda g/2$, where $\lambda g$ is the guided wave-length in said radiating line; and coupling means for coupling said radiating lines of said antenna elements.

19. An antenna element as claimed in claim 18, wherein said antenna elements have a common said conductive plate.

20. Antenna apparatus including a multiple of four antenna elements as claimed in claim 18 and coupling means for coupling said antenna elements to form "sum" and "difference" channels.

* * * * *

UNITED STATES PATENT AND TRADEMARK OFFICE

CERTIFICATE OF CORRECTION

PATENT NO. : 4,804,965

DATED : February 14, 1989

INVENTOR(S) : Roederer

It is certified that error appears in the above-identified patent and that said Letters Patent is hereby corrected as shown below:

Column 1, line 59 change "3 g/4" to --3λg/4--.
Column 3, line 67 change "array" to --an antenna array--.
Column 7, line 25 change "angualr" to --angular-- and change "trashing" to --tracking--;
line 56 change "elongated" to --elongate--.
Column 8, line 10 change "therefor" to --therefore--;
line 15 change "secondary" to --second secondary--;

line 42 change "13" to --10--;
line 52 change "15" to --12--;
line 63 change "elements" to --elements such that the maximal gain is normal to--.

Signed and Sealed this

Tenth Day of July, 1990

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,804,965

DATED : 14 February 1989

INVENTOR(S) : A. G. ROEDERER

It is certified that error appears in the above-identified patent and that said Letters Patent is hereby corrected as shown below:

| Column | Line | |
|---|---|---|
| 8 | 24 | Delete "gate". |

Signed and Sealed this

Second Day of October, 1990

*Attest:*

HARRY F. MANBECK, JR.

*Attesting Officer*

*Commissioner of Patents and Trademarks*